US005213480A

United States Patent [19]

Yedinak et al.

[11] Patent Number: 5,213,480

[45] Date of Patent: May 25, 1993

[54] PUMP LIFT MECHANISM

[75] Inventors: John A. Yedinak, Downers Grove, Ill.; Mark B. Snyder; Arthur W. Paape, both of St. Paul, Minn.

[73] Assignee: Graco, Inc., Minneapolis, Minn.

[21] Appl. No.: 894,263

[22] Filed: Jun. 8, 1992

[51] Int. Cl.[5] ..... F04B 21/00; F04B 17/06; F04B 35/06

[52] U.S. Cl. ..... 417/234; 417/360; 417/361

[58] Field of Search ..... 417/234, 361, 360, 423.15, 417/572

[56] References Cited

U.S. PATENT DOCUMENTS

| | | | |
|---|---|---|---|
| 2,212,749 | 8/1940 | Pelouch | 221/47.1 |
| 2,236,095 | 3/1941 | Ginter | 312/151 |
| 2,602,694 | 7/1952 | Richardson | 299/31 |
| 3,305,137 | 2/1967 | Gautheir et al. | 417/234 |
| 3,539,079 | 11/1970 | Loe | 222/176 |
| 3,655,137 | 4/1972 | Lang | 239/670 |
| 4,624,602 | 11/1986 | Kieffer et al. | 404/94 |

*Primary Examiner*—Richard A. Bertsch
*Assistant Examiner*—Alfred Basichas
*Attorney, Agent, or Firm*—Douglas B. Farrow

[57] ABSTRACT

A small wheelable line striper is provided with a gasoline engine powered pump which has an outlet designed for direct immersion into a container of paint or other coating material. The gasoline engine and pump are mounted on a pump frame which is attached to two telescoping posts so that the pump and engine may be lifted upwardly out of the bucket of paint. The pump frame is biased upwardly by a nitrogen gas spring which provides an upward force slightly greater than the weight of the engine and pump so that the pump may be lifted automatically. Latches are provided to latch the pump and engine in either the upward or downward positions.

10 Claims, 3 Drawing Sheets

PUMP LIFT MECHANISM

BACKGROUND OF THE INVENTION

Portable line stripers which are self-contained and which may be wheeled about by an operator have been known for a number of years. Such machines often utilize gasoline engine driven airless pumps which may have a flexible inlet tube which may be inserted into a bulk container of paint or other material to be applied.

Some pump types have a fixed inlet, so that it is desired that the gasoline engine generally not be tilted significantly from its normal operating position, especially if the engine is of the four cycle variety. Such tipping will cause lubricating oil to run into the combustion chamber and cause excessive smoking and difficult operation.

SUMMARY OF THE INVENTION

It is therefore an object of this invention to provide a line striping mechanism which has a pump mounted so that it may be easily removed and inserted into a bulk container of paint and which may be easily so operated by the operator.

It is further an object of this invention to provide such a striper which will allow the engine to remain in its preferred operating position at all times as well as a handle for pushing.

An airless spray gun may be mounted to the platform for application of paint or other material to a parking lot or other surface to be marked. A pair of posts extend upwardly from one end of the main frame and have telescopically located thereover a pair of complementary posts to which are mounted a pump frame. Attached to the pump frame is a gasoline engine which in turn operates a pump of the type generally known for use in Graco Inc.'s PT2500 sprayer.

A nitrogen gas spring of the type generally used for automotive hatchbacks and the like is mounted between the main frame and the pump frame to bias the pump frame upwardly from the the main frame. The spring is selected so as to provide an upward force slightly greater than the weight of the pump and engine such that the pump frame kind of engine is raised automatically with minimal effort by one hand of an operator. A handle is provide at the side of the pump frame for operation of the same along with the latch which allows the operator to secure the pump frame in either the operating or refilling positions.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
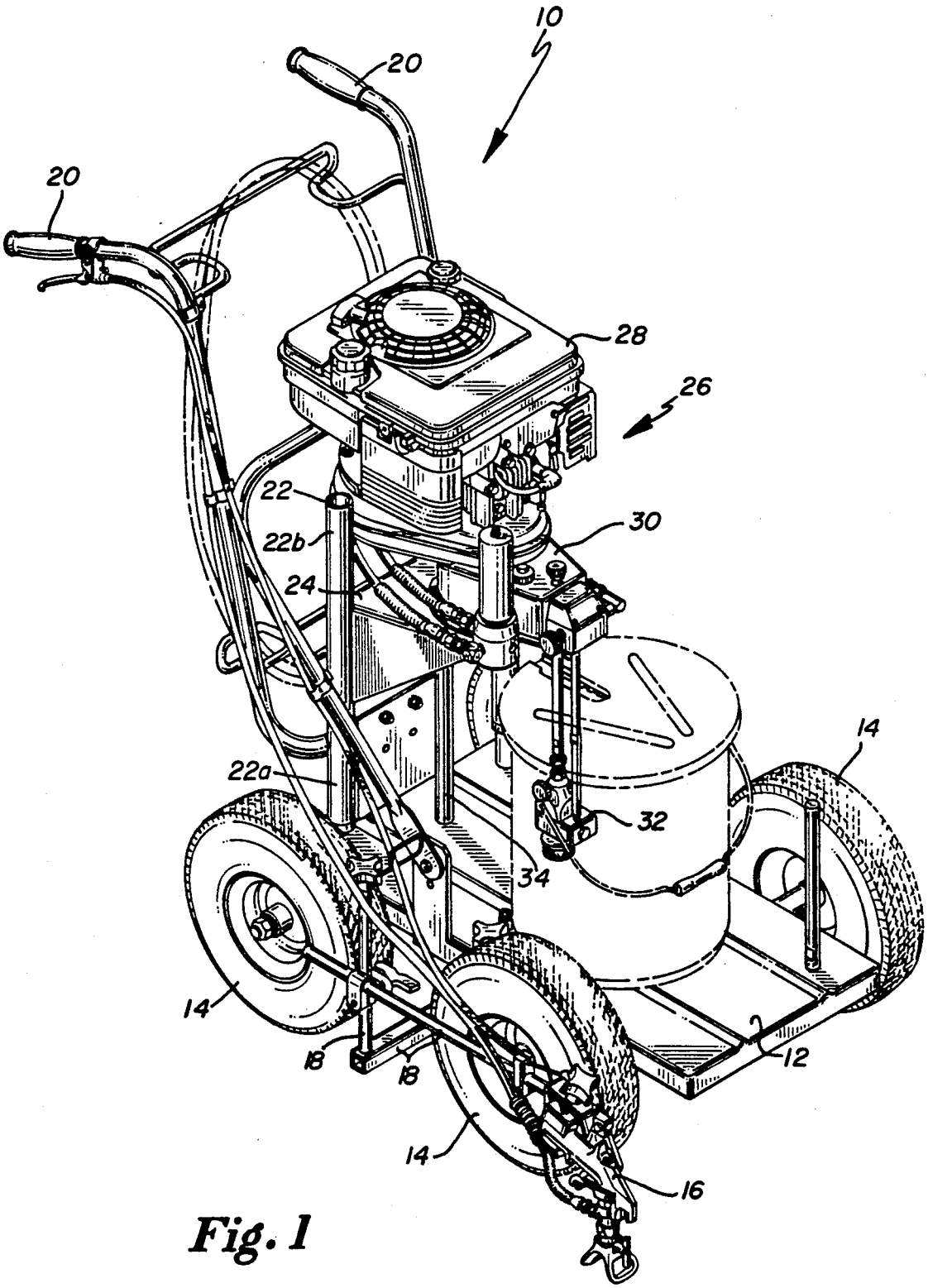
FIG. 1 is a perspective view showing the pump lift mechanism of the instant invention as applied with a line striper.

The pump lift of the instant invention, generally designated 10 is shown in FIG. 1 in conjunction with the line striper which is comprised generally of a main frame 12 which is generally rectangular and is supported by three or more rotatably mounted wheels 14. An airless spray gun 16 is mounted via an adjustable outboard mounting mechanism 18 which is in turn attached to main frame 12. A handle assembly 20 extends upwardly from main frame 12 for manipulation by the operator.

Figure 2:
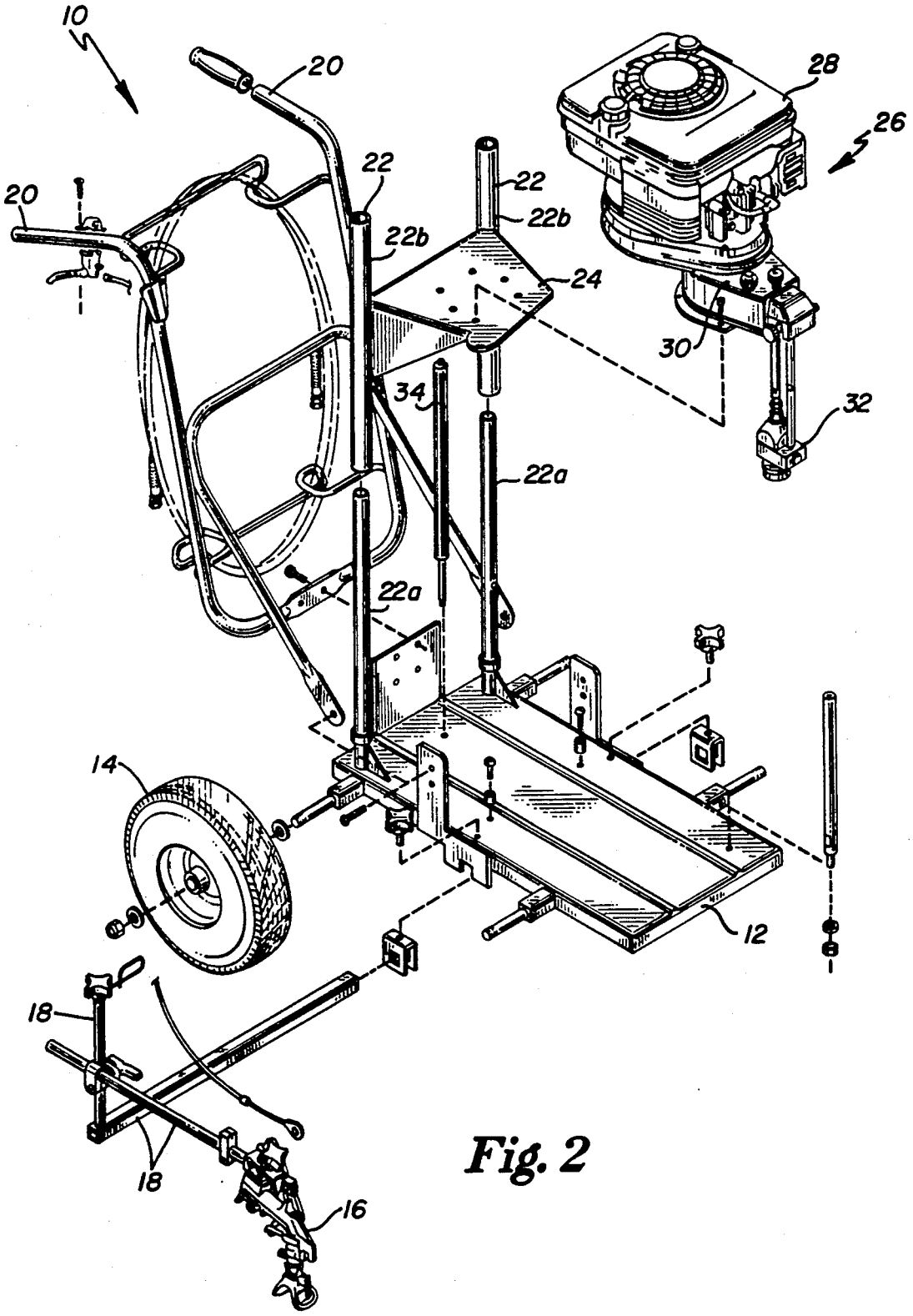
FIG. 2 is a exploded perspective view showing the pump lift mechanism.

As can be seen in more detail in FIG. 2, a pair of telescoping tube sets 22 are comprised of a first telescoping tube **22*a* mounted to main frame 12 and second telescoping tube member 22*b* which have attached thereto pump frame 24**.

Mounted to pump frame 24 is an engine/pump set 26 which is comprised generally of a gasoline engine 28 which may preferably be of the 4 cycle type along with a pump 30 having an inlet 32 extending downwardly therefrom. A nitrogen gas spring 34 is mounted between main frame 12 and pump frame 24 and provides an upward force to pump frame 24 slightly greater than the weight of engine/pump assembly 26.

Figure 3:
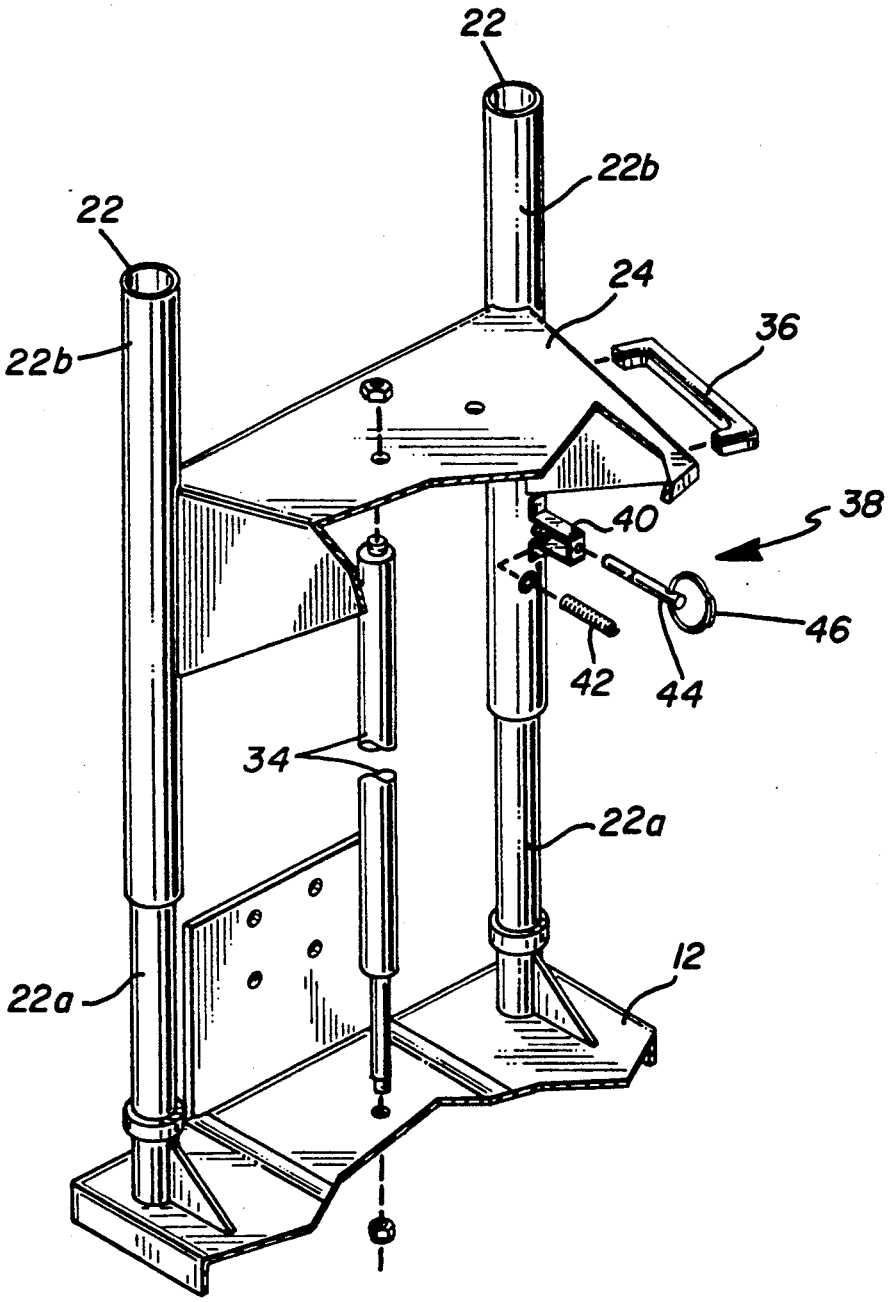
FIG. 3 shows a detail of the pump lift mechanism also in cut-away perspective view.

FIG. 3 shows in detail pump frame 24 which has attached to the side thereof a handle 36. Latch mechanism 38 is comprised generally of a bracket 40, spring 42, pin 44 and handle ring 46 along with the corresponding holes 48 in upper telescoping tube **22*b* and lower telescoping tube 22*a***. This assembly allows the pump lift mechanism to be latched in the upward position or downward position.

Thus, FIG. 1 shows the instant invention ready for spraying or other operations. When it is desired to either change materials or provide a new container of material, the operator need merely grasp ring 46 and pull outward while the engine/pump assembly 26 lifts automatically. When telescoping tubes 22 are raised near the upper limits of their travel, pin 44 will snap over the top end of tube **22*a* thereby (in conjunction with the travel limit on gas spring 34) locking pump frame 24** in its upward position.

Once the change has been completed, the operator need merely repeat the process. Even with todays relatively light weight gasoline engines and pumps, the weight of assembly 26 and pump frame 4 is still substantial enough that the instant invention affords a great increase in operator convenience and productivity.

It is contemplated that various changes and modifications may be made to the pump lift mechanism without departing from the spirit and scope of the invention as defined by the following claims.

What is claimed is:

1. A pump lift mechanism for pumping fluid out of a bulk container, said pump lift mechanism comprising:

a main frame having a surface thereon for receiving said bulk container;

at least one telescoping tube means having a fixed portion attached to said main frame and a portion moveable relative to said fixed portion;

a pump frame attached to said moveable portion;

pump means attached to said pump frame; and means biasing said pump frame away from said main frame.

2. The pump lift mechanism of of claim 1 wherein said telescoping tube means extends upwardly from said main frame.

3. The pump lift mechanism of claim 2 wherein said pump means comprises an inlet tube extending downwardly towards said main frame.

4. The pump lift mechanism of claim 2 comprising first and second said telescoping tube means.

5. The pump lift mechanism of claim 4 wherein said biasing means is located intermediate said first and second telescoping tube means.

6. The pump lift mechanism of claim 2 wherein said biasing means comprises a gas spring.

7. The pump lift mechanism of claim 1 wherein said biasing means produces a force at least approximately equal to the weight of said pump means and said pump frame.

8. The pump lift mechanism of claim 7 wherein said biasing means produces a force greater than the weight of said pump means and said pump frame.

9. The pump lift mechanism of claim 1 further comprising latch means associated with said telescoping tube means, said telescoping tube means being moveable between operative and replacement positions.

10. The pump lift mechanism of claim 9 wherein said latch means operates to retain said telescope tube means in at least one of said positions.

* * * * *